US011185974B2

(12) United States Patent
Omry et al.

(10) Patent No.: US 11,185,974 B2
(45) Date of Patent: Nov. 30, 2021

(54) TOOLBOX WITH SLIDABLE ORGANIZER TRAY

(71) Applicant: The Stanley Works Israel Ltd., Rosh Ha'Ayin (IL)

(72) Inventors: Adar Omry, Tel-Aviv (IL); Boaz Sarfati, Kiryat Ono (IL)

(73) Assignee: The Stanley Works Israel Ltd., Rosh Ha'Ayin (IL)

( * ) Notice: Subject to any disclaimer, the term of this patent is extended or adjusted under 35 U.S.C. 154(b) by 0 days.

(21) Appl. No.: 16/354,736

(22) Filed: Mar. 15, 2019

(65) Prior Publication Data

US 2019/0210213 A1 Jul. 11, 2019

Related U.S. Application Data

(63) Continuation of application No. PCT/IB2017/055779, filed on Sep. 22, 2017.

(60) Provisional application No. 62/398,907, filed on Sep. 23, 2016.

(51) Int. Cl.

| | |
|---|---|
| ***B25H 3/02*** | (2006.01) |
| ***B25H 3/06*** | (2006.01) |
| ***B65D 5/04*** | (2006.01) |
| ***B25H 3/00*** | (2006.01) |

(52) U.S. Cl.

CPC ..... *B25H 3/02* (2013.01); *B25H 3/003* (2013.01); *B25H 3/06* (2013.01); *B65D 5/04* (2013.01)

(58) Field of Classification Search

CPC ..... B25H 3/02; B25H 3/025; B25H 3/021; B25H 3/023; B25H 3/028; B25H 3/003; B25H 3/0027; B25H 3/06; B25H 3/022

USPC ..... 190/30; 206/379

See application file for complete search history.

(56) References Cited

U.S. PATENT DOCUMENTS

| | | | | | |
|---|---|---|---|---|---|
| 475,617 | A | * | 5/1892 | Seward | A45C 13/02 190/30 |
| 696,846 | A | * | 4/1902 | Seward | A45C 13/02 190/30 |
| 2,501,879 | A | * | 3/1950 | Sulentic | A45C 13/02 312/199 |
| 2,631,079 | A | * | 3/1953 | Strocco | A45C 13/02 312/276 |
| 3,985,409 | A | | 10/1976 | Kneier | |
| 4,714,158 | A | * | 12/1987 | Oltman | A45C 13/02 16/111.1 |
| 5,169,018 | A | | 12/1992 | Fiore | |
| 5,628,422 | A | * | 5/1997 | Garbacik, Jr. | B65D 43/168 220/266 |
| 5,680,932 | A | * | 10/1997 | Dickinson | B25H 3/02 206/372 |
| 6,193,062 | B1 | | 2/2001 | Rysgaard et al. | |

(Continued)

FOREIGN PATENT DOCUMENTS

| | | | | |
|---|---|---|---|---|
| DE | 102008043800 A1 | * | 5/2010 | E05D 5/06 |
| NL | 1002290 C2 | * | 8/1997 | B25H 3/023 |

OTHER PUBLICATIONS

DE_102008043800_translation.pdf.*

*Primary Examiner* — Allan D Stevens
(74) *Attorney, Agent, or Firm* — Bruce S. Shapiro

(57) ABSTRACT

The present disclosure relates to a toolbox or container having a selectively removable organizer tray that is pivotally attached to the lid of the toolbox. As a user opens the lid of the toolbox, the organizer tray retracts into the lid reducing the organizer tray's obscuring of the interior space of the toolbox.

8 Claims, 6 Drawing Sheets

(56) References Cited

U.S. PATENT DOCUMENTS

| | | | | |
|---|---|---|---|---|
| 8,256,820 | B2 | 9/2012 | Spencer | |
| 8,276,752 | B1 * | 10/2012 | Meng | B25H 3/027 206/1.5 |
| 2002/0117947 | A1 * | 8/2002 | Cheng | A47B 87/008 312/327 |
| 2007/0241159 | A1 * | 10/2007 | Chang | A45F 5/02 224/677 |
| 2008/0157556 | A1 * | 7/2008 | Henderson | B62D 33/0273 296/37.6 |
| 2011/0204087 | A1 * | 8/2011 | Kopulos | B65D 21/0219 220/810 |
| 2014/0102928 | A1 | 4/2014 | Sabbag et al. | |
| 2014/0265197 | A1 * | 9/2014 | Russell | B25H 3/02 280/79.3 |

* cited by examiner

TOOLBOX WITH SLIDABLE ORGANIZER TRAY

CROSS-REFERENCE TO RELATED APPLICATION

This application is a continuation of International application PCT/IB2017/055779 filed Sep. 22, 2017 which claims the benefit of U.S. Provisional Application No. 62/398,907 filed Sep. 23, 2016.

FIELD OF THE INVENTION

The present application relates to a toolbox, and more particularly to a toolbox including a selectively removable and slidable organizer tray.

BACKGROUND OF THE INVENTION

Carpenters and handy persons are often looking for new ways to protect, organize and transport their tools. Toolboxes have become a common way to achieve that task. Common toolboxes have an interior space and may include an organizer tray. When the lid to the toolbox is opened, these organizer trays do not retract and obscure access to the interior space of the toolbox.

The present invention overcomes one or more of the drawbacks discussed above.

BRIEF SUMMARY OF THE INVENTION

The present application discloses a container defining an interior space that is suitable for enclosing and transporting tools. The container includes a selectively removable organizer tray configured to be stored in the interior space and comprising at least one sled foot and at least one engagement protrusion. The container further includes a right side wall and a left side wall, wherein at least one of the side walls contain a cut-out portion configured to receive a sled foot of the organizer tray. The container further includes a back wall, a front wall and a bottom wall. The container also contains a lid pivotally connected to the back wall and comprising at least one tray receiving portion configured to receive an engagement protrusion of the organizer tray.

BRIEF DESCRIPTION OF THE DRAWINGS

An embodiment of the invention will now be described by way of example with reference to the drawings in which.

DETAILED DESCRIPTION OF THE INVENTION

Figure 1:
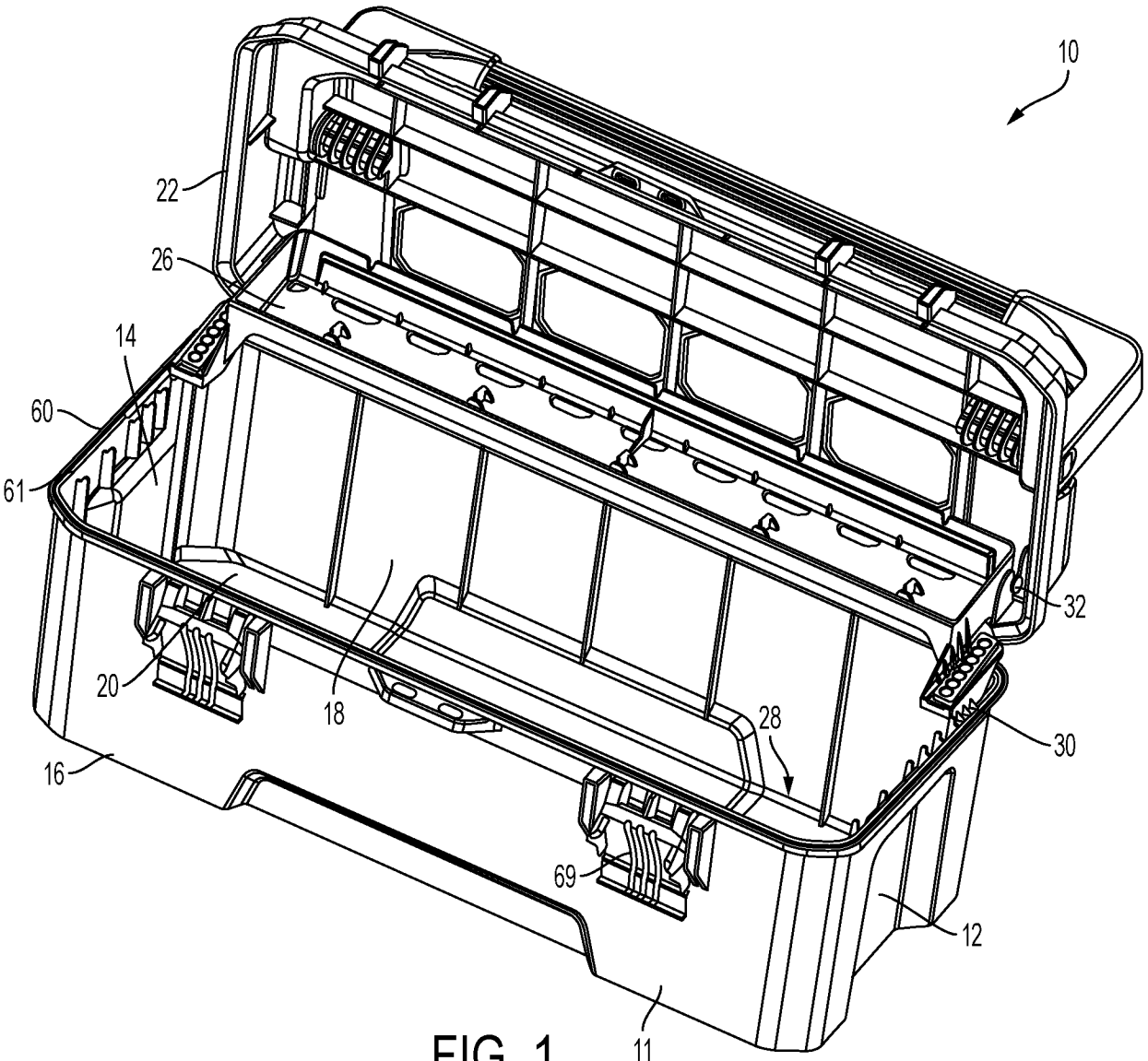
FIG. 1 is a perspective view of a toolbox with a selectively removable and slidable organizer tray according the invention.
Figure 2:
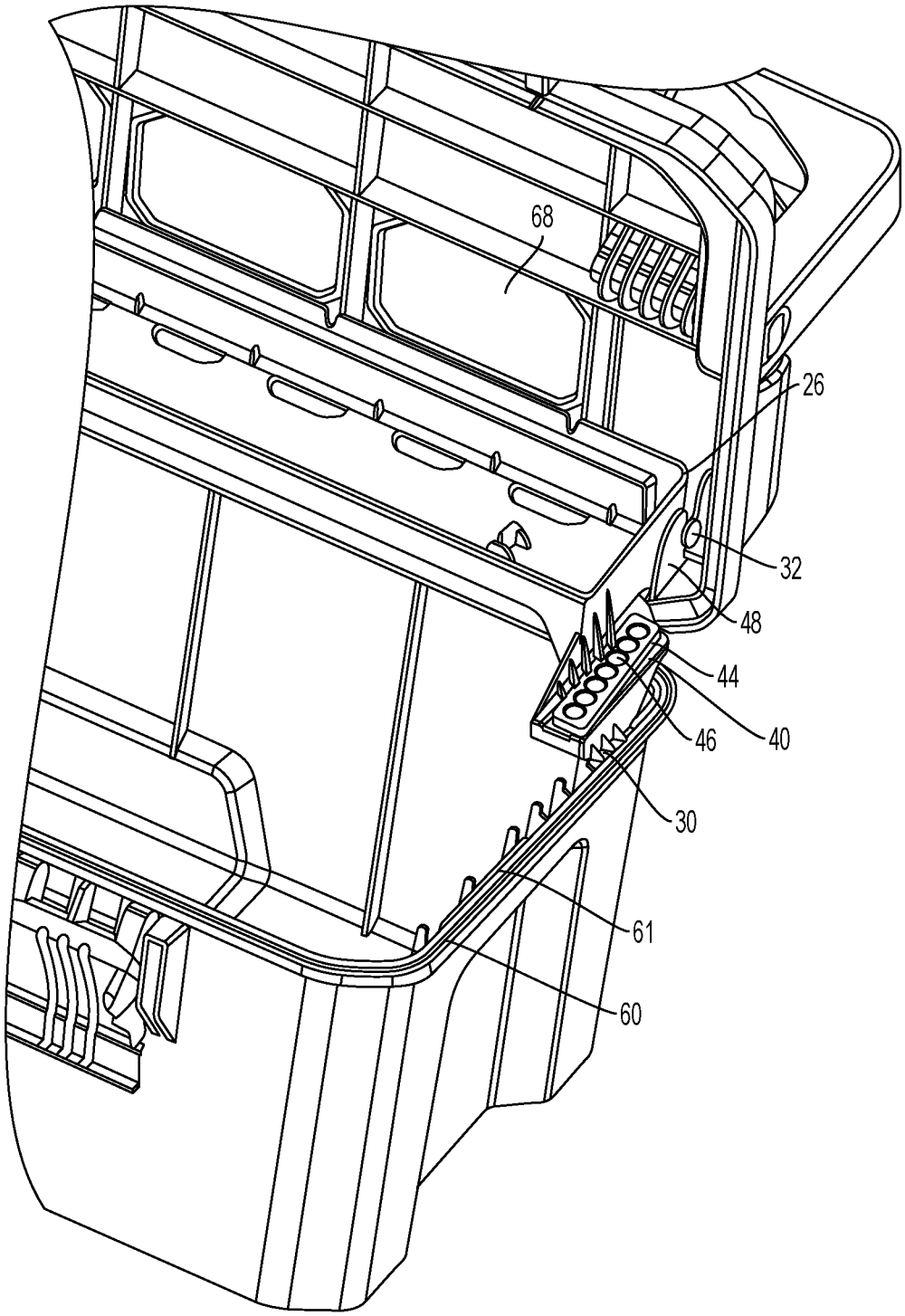
FIG. 2 is a detailed perspective view of the toolbox with a selectively removable and slidable organizer tray according to the invention.
Figure 3:
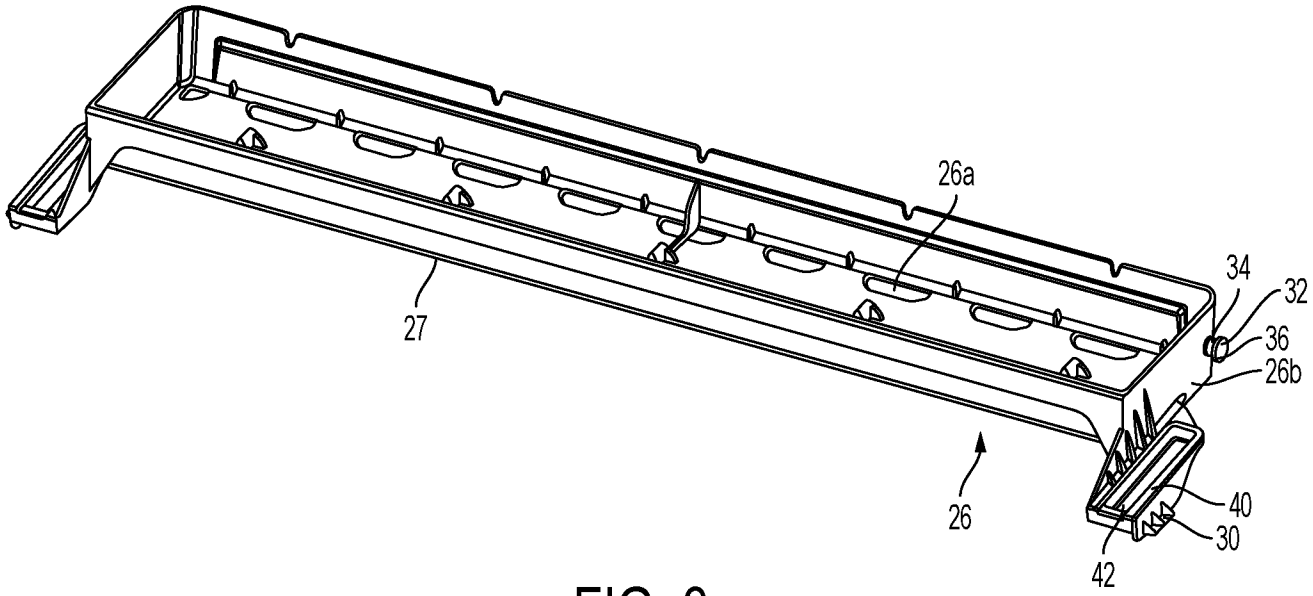
FIG. 3 is a perspective view of the selectively removable and slidable organizer tray according to the invention.
Figure 4:
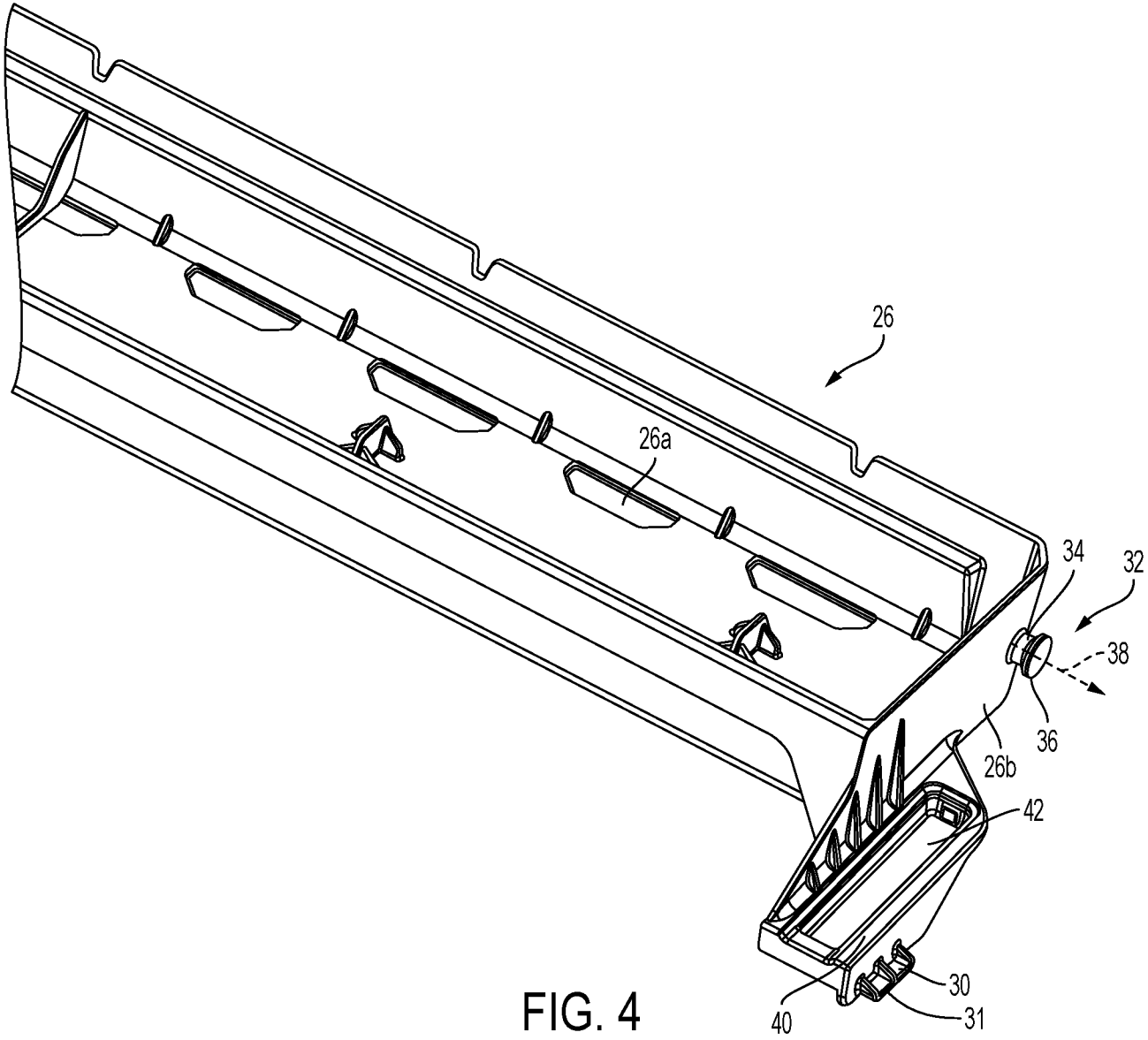
FIG. 4 is a detailed perspective view of the selectively removable and slidable organizer tray according to the invention.

FIG. 1 discloses an embodiment of a toolbox or storage box 10 with selectively removable and slidable organizer tray 26. The toolbox or storage box 10 includes a container 11 comprising a right side wall 12, a left side wall 14, a front wall 16, a back wall 18, a bottom wall 20, and a lid 22. As is better seen in FIG. 5, the lid 22 is pivotally attached the back wall 18 through one or more pivots 24. Those skilled in the art will recognize that lid 22 can be pivotally attached to the back 18 in a variety if manners. The lid 22 is configured to move between a closed position, wherein access to the interior space 28 of the toolbox 10 is prohibited; and an open position, wherein access to the interior space 28 is not prohibited.

Toolbox 10 also includes a selectively removable and slidable organizer tray 26. Organizer tray 26 is configured to be stored in the interior space 28 defined by container 11 of toolbox 10. Organizer tray 26 includes a main tray portion 26*a* having a main tray support surface 26*c* and an outermost side wall 26*b* disposed at the laterally outward edge of the main tray support surface 26*c*, and at least one sled foot or sled portion 30 extending laterally outwardly of outermost side wall 26*b* of main tray portion 26*a*. Sled foot 30 is a small outward extension that includes a generally flat bottom surface 31. Sled foot 30 is configured to allow the organizer tray to slide back and forth along a suitable surface. Organizer tray 26 also includes at least one engagement protrusion 32 extending laterally outwardly of main tray portion 26*a*. Engagement protrusion 32 may comprise a neck portion 34 and a securing portion 36. The neck portion 32 and securing portion 36 are positioned with respect to one another such that there is a single axis 38 that runs there through. In a preferred embodiment, the neck portion 34 may generally be cylindrical. In a preferred embodiment, the securing portion 36 may be circular. Moreover, the area of the circular securing portion 36 is preferably greater than the cross sectional area of the cylindrical neck portion 34. Those skilled in the art will recognize that the neck portion 34 and securing portions 36 may be shaped differently without parting from the scope and spirit of the disclosed invention.

Organizer tray 26 may further include a utility surface 40 extending laterally outwardly of main tray portion 26*a* which is defined between side walls 26*b*. Utility surface 40 may define a depression 42 that is configured to receive an accessory cup 44. Accessory cup 44 may be configured to receive any number of accessories. For example, as shown in FIG. 1, accessory cup 44 has a number of circular holders 46 that are configured to receive and secure drill bits. Those skilled in the art will recognize that accessory cup 44 may be configured to hold other accessories such as screws, nails, or any accessory. In a preferred embodiment, the sled foot 30 extends laterally of the utility surface 40.

Figure 5:
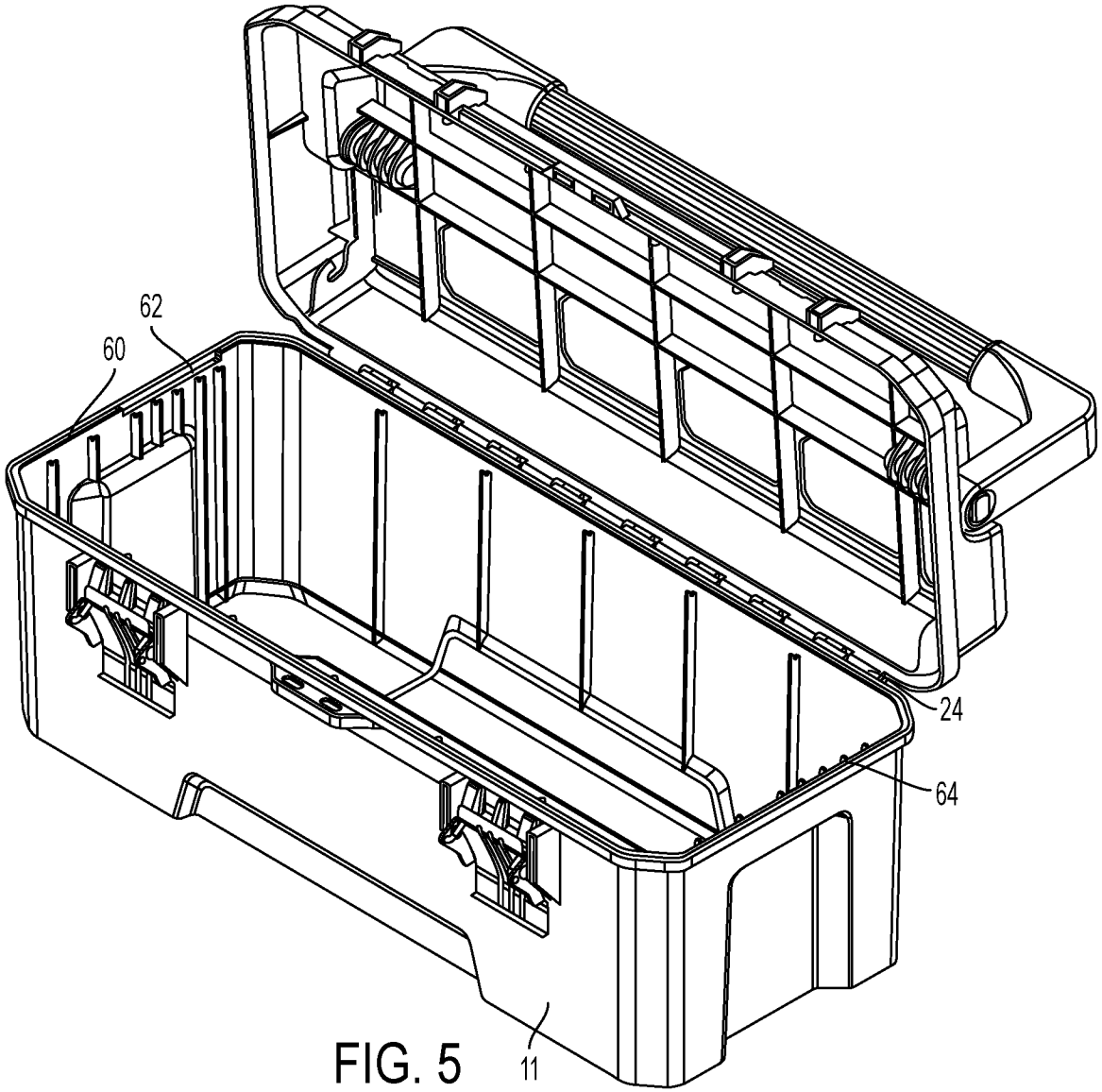
FIG. 5 is a perspective view of the toolbox according to the invention, with the selectively removable and slidable organizer tray removed therefrom.
Figure 6:
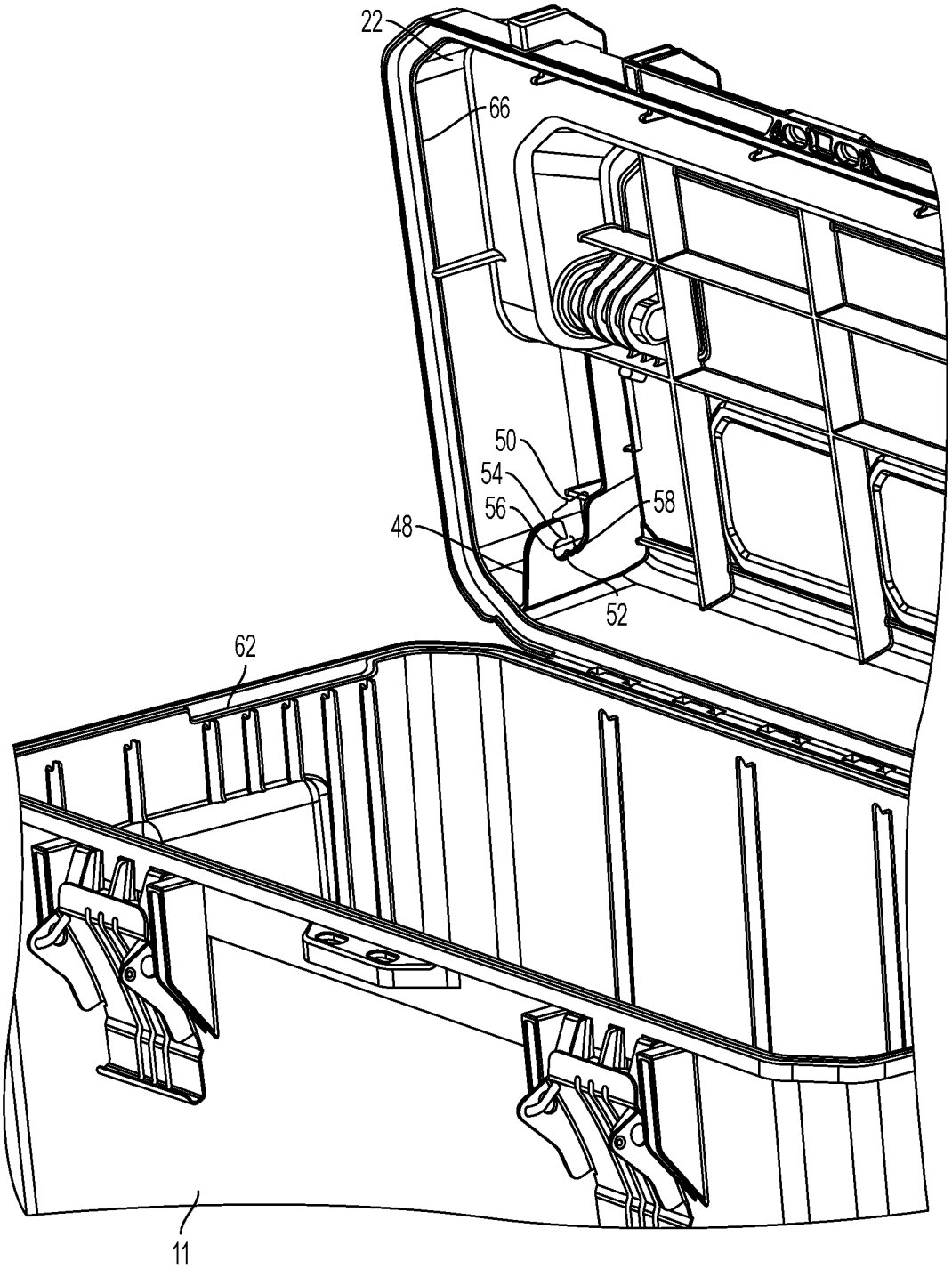
FIG. 6 is a detailed perspective view of the toolbox according to the invention, with the selectively removable and slidable organizer tray removed therefrom.

As show in FIGS. 5 and 6, the lid 22 of toolbox 10 includes one or more tray receiving portions 48 that are configured to receive the engagement protrusion 32 of the organizer tray 26. The tray receiving portion 48 may be generally hook shaped and define an initial opening 50 that is configured to receive the neck portion 34 of the engagement protrusion 32. The tray receiving portion 48 may further include a locking ridge 52 and a locking hook 54. In a preferred embodiment, the tray receiving portion 48 defines a curve 56 between the locking ridge 52 and the locking hook 54 may generally be described as semi-circular. The curve 56 is configured to receive a neck portion 34 of an engagement protrusion 34. The space between the locking ridge 52 and the locking hook 54 that is not defined by the tray receiving portion 48 may be described as the locking opening 58. The locking opening 58 may be sized such that a neck portion 34 may not pass there through without the application of moderate force. If said force is applied, the neck portion 34 slightly displaces the locking hook 54 and passes through the locking opening 58 and come to a rest in curve 56. In this position, the locking hook 54, which is no longer displaced, locks the neck portion into place against curve 56. The neck portion 34 will remain in place until moderate force is applied in the opposite direction to again displace the locking hook 54 thereby allowing the neck portion 34 to pass back through the locking opening 58. At that point, the neck portion can then be moved back out of the initial opening 50. In this way the selectively removable and slidable organizer tray 26 may be removed from the tool box 10.

In a preferred embodiment, the right side wall 12, back wall 18, left side wall 14, and front wall 16 of container 11 are contiguous, and include a ridge 60. Just below this ridge 60 is an interior ledge 61 that is substantially contiguous. Two cut-out portions may be included within this interior ledge 61. The first cut-out portion 62 may be a part of the interior ledge 61 that runs along the right side wall 12 and a second cut-out portion 64 may be a part of interior ledge 61 that runs along the left side wall 14. These cut-out portions 62, 64 are configured to receive a sled foot 60 of the organizer tray 26. More specifically, these cut-out portions 62, 64 are configured to allow the flat bottom surface 31 of a sled foot 30 to easily slide there upon.

As shown in FIGS. 5 and 6, the lid 22 may further include a seal 66 that is configured to engage the interior ledge 61, when the lid 22 is in its closed position. Seal 66 is operative to limit moisture and debris from entering the interior space 28 and damaging the contents therein.

INDUSTRIAL APPLICABILITY

The toolbox 10 described herein contains a selectively removable and slidable organizer tray 26. The toolbox 10 and organizer tray 26 are useful for enclosing, protecting and transporting tools and the like. The selective insertion and removal of the organizer tray 26 will now be described.

FIG. 5 depicts the toolbox 10 with the lid 22 in its open opposition and the organizer tray 26 removed therefrom. When a user wants to insert an organizer tray 26 inside the toolbox 10, she moves the lid 22 to its open position and positions the organizer tray 26 therein. In a preferred embodiment, organizer tray 26 includes two engagement protrusions 32, one on the left side and one on the right. Similarly, the lid 22 also includes two tray receiving portions 48 that are positioned on both the left and right to receive the respective engagement protrusions 32 of the organizer tray. For simplicity, we will describe the insertion and removal of a single engagement protrusion 34 into a tray receiving portion 48. However, those skilled in the art will recognize that the same process may be carried out on either the left or right side.

Neck portion 34 is first positioned within the initial opening 50 and moved against the locking opening 58. A user will then apply moderate force to the neck portion 34. This force will displace the locking hook 58 and slightly increase the locking opening 58. The increased distance of the locking opening 58 allows the neck portion 34 to pass there through. Once through the locking opening, the neck portion 34 is received into curve 56. The locking hook 58, which is no longer displaced, moves back to its initial position and locks the neck portion 34 into position. Engagement protrusions 32 also include a securing portion 36. Securing portion 36 prevents movement of the organizer tray 26 transverse to the direction of force applied to insert the neck portion 34 into the locking opening 58.

Once the engagement protrusions 32 are secured within the tray receiving portions 48, the organizer tray 26 is free to pivot around axis 38. In a preferred embodiment, axis 38 runs through both the engagement protrusion on the right side and on the left side. Although the organizer tray 26 is configured to pivot around axis 38, the organizer tray 26 is not permitted to rotate down into the interior space 28. Indeed, doing so would allow any materials held within the organizer tray to fall out into interior space 28. In order to prevent this undesirable occurrence, sled feet 30, which preferably are on both the left and right sides, are configured to engage cut-outs 62, 64. More specifically, the flat bottom surface 31 of sled feet 30 are configured to engage the cut out portions 62, 64 which thereby from a support surface.

Cut-outs 62, 64 may be of a finite distance allowing the organizer tray 26 to slide back as the lid 22 is opened, and forward as the lid 22 is closed. Specifically, as the lid 22 is closed, organizer tray slides forward. When the lid 22 in the closed position, the organizer tray 26 is in a relatively forward position within the toolbox 10. However, when the lid 22 is in the open position, the organizer tray 26 is retracted into the lid 22 thereby reducing the amount that the organizer tray obscures the interior space 28.

When the lid is in the open position, the pivoting nature of the organizer tray 26 also may also prevent the backward tipping of the entire toolbox 10. For example, when a user seeks to remove a large item, such as a hammer, from the interior space 28, she may inadvertently hit the bottom 27 of the organizer tray 26 with the hammer. If this happens, the organizer tray 26 will lift slightly as flat bottom surfaces 31 of the sled feet 30 disengage from the cut-outs 62, 64 and the organizer tray 26 pivots around axis 38. As soon as the user realizes her error, she will disengage the hammer from the bottom 27 of the organizer tray 26. Gravity will then allow the organizer to fall back into its original position where the flat bottom surfaces 31 of the sled feet 30 reengage the cut-outs 62, 64. If the organizer tray 26 was not allowed to pivot, and instead was fixed in its position within the toolbox 10, such a mistake as described above could result in the entire toolbox 10 flipping over.

Finally, those skilled in the art may will recognize that container 11 of the toolbox 10 of the present invention may also have other features such as one or more latches 69 that secure the lid 22 to the front wall 16. Toolbox 10 may also include one or more transparent windows 68 that allows a user to have visual access to the contents of the organizer tray 26 or interior space 28 when the lid is in the closed position.

While the present invention has been described in connection with what is considered the most practical and preferred embodiments, it is understood that this invention is not limited to the disclosed embodiments but is intended to cover various arrangement included within the spirit and scope of the broadest interpretation of the attached claims so as to encompass all such modifications and equivalent arrangements.

We claim:

1. A storage box comprising:

a container including a right side wall, a left side wall, a back wall and a front wall defining an interior space, at least one of the side walls contain a cut-out portion;

a selectively removable and slidable organizer tray configured to be stored in the interior space and comprising a main tray portion and at least one sled foot extending laterally outwardly of said main tray portion and at least one engagement protrusion extending from said main tray portion, said at least one sled foot received in said cut-out portion, said tray further including a utility surface extending laterally outwardly of said main tray portion;

an accessory cup disposed on said utility surface; and a lid pivotally connected to the back wall and comprising at least one tray receiving portion configured to receive said at least one engagement protrusion of the organizer tray.

2. The storage box recited in claim 1, wherein the lid is movable between a closed position and an open position, and wherein in the closed position, access to the interior space is prohibited, and in the open position, access to the interior space is not prohibited and the organizer tray is partially retracted into the lid thereby reducing the organizer tray's obscuring of the interior space.

3. The storage box recited in claim 2, wherein the engagement protrusion of the organizer tray engages the tray receiving portion of the lid such that the tray is pivotable around a central axis of the engagement protrusion.

4. The storage box recited in claim 3, wherein the cut-out portion is located at an interior ledge of the at least one of the side walls.

5. The storage box recited in claim 1, wherein said storage box includes a seal that limits water or debris from reaching the interior space when the lid is in its closed position.

6. The storage box recited in claim 1, wherein said storage box includes at least one transparent window that allows visual access to the organizer tray or interior space when the lid is in its closed position.

7. The storage box recited in claim 1, wherein, said sled foot extends downwardly and laterally outward of said utility surface.

8. A storage box comprising:

a container including a right side wall, a left side wall, a back wall and a front wall defining an interior space, at least one of said side walls including a first support surface;

a selectively removable and slidable organizer tray configured to be stored in the interior space and comprising a main tray portion having a main tray support surface and an outermost side wall disposed at the laterally outward edge of said main tray support surface, a utility surface disposed laterally outwardly of said outermost side wall of said main tray portion and configured to receive an accessory cup, said utility surface formed discontinuously of and lower than said main tray support surface, and at least one sled foot slidably supported on said first support surface; and a lid pivotally connected to the back wall.

* * * * *